United States Patent [19]

Gadd

[11] 4,006,504

[45] Feb. 8, 1977

[54] AUTOMATIC HEEL AND SIDE LASTING SHOE MACHINES

[75] Inventor: Ronald O. C. Gadd, Leicester, England

[73] Assignee: USM Corporation, Boston, Mass.

[22] Filed: Aug. 27, 1975

[21] Appl. No.: 608,327

[30] Foreign Application Priority Data

Aug. 27, 1974 United Kingdom ..... 37307/74

[52] U.S. Cl. ..... 12/8.3

[51] Int. Cl.[2] ..... A43D 21/00

[58] Field of Search ..... 12/8.3, 12, 12.4, 12.5, 12/126, 127

[56] References Cited

UNITED STATES PATENTS

| | | | |
|---|---|---|---|
| 3,591,878 | 7/1971 | Mahlbach | 12/8.3 |
| 3,651,526 | 3/1972 | Ogawa | 12/12 |
| 3,685,072 | 8/1972 | Schindler et al. | 12/12 |
| 3,849,818 | 11/1974 | Brailsford | 12/8.3 |

*Primary Examiner*—Patrick D. Lawson

*Attorney, Agent, or Firm*—Donald N. Halgren; Richard B. Megley; Vincent A. White

[57] ABSTRACT

A combined heel seat lasting and side lasting machine comprising heel seat wipers and helically ribbed rotatable side lasting rolls, for automatically lasting the side and heel portions of shoe assemblies. Shoe assembly support means comprising a movable jack mounted in a carriage presents a previously toe lasted shoe assembly to the side lasting rolls and the heel seat lasting wipers in sequence.

4 Claims, 1 Drawing Figure

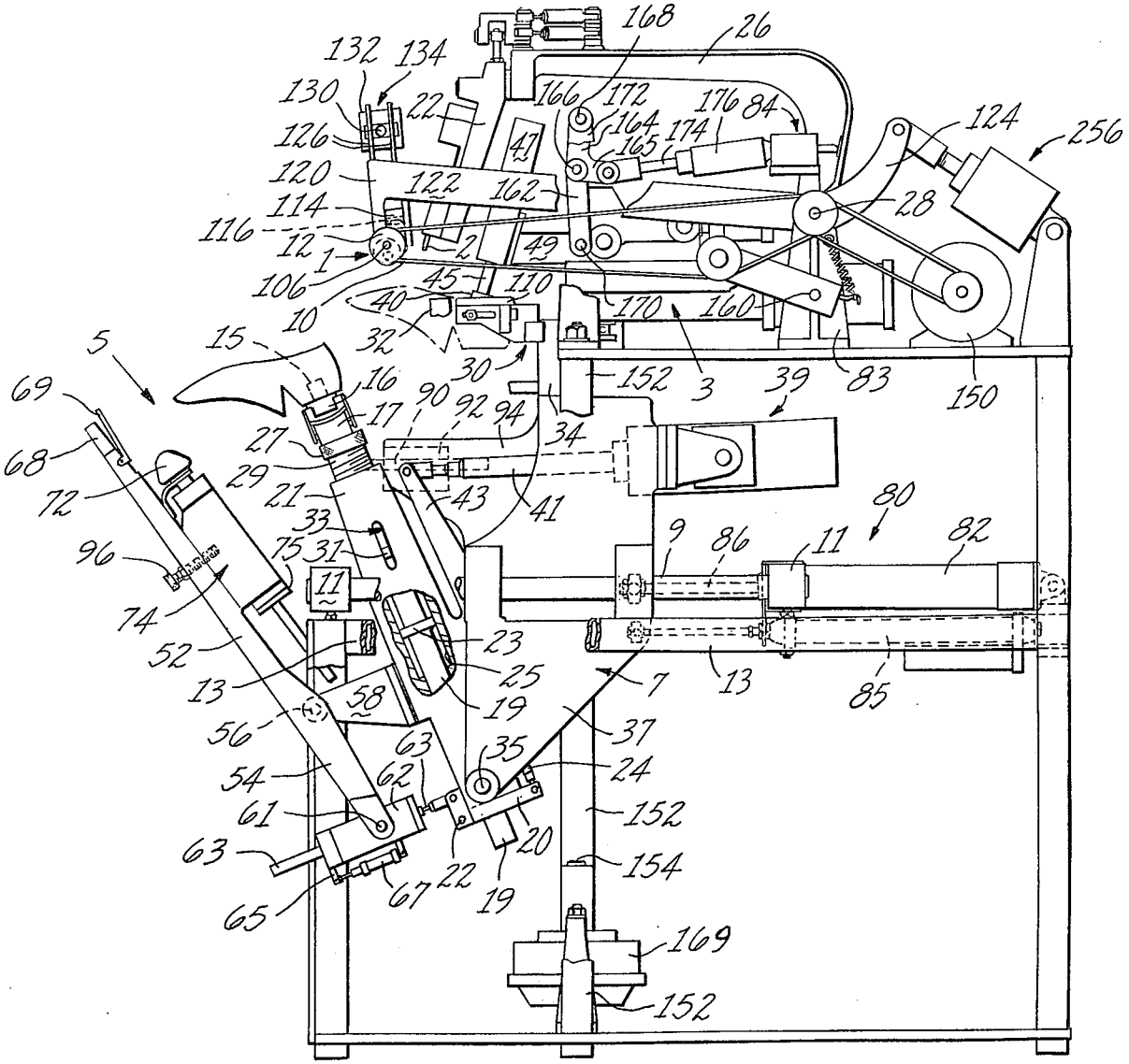

AUTOMATIC HEEL AND SIDE LASTING SHOE MACHINES

BACKGROUND OF THE INVENTION

1. Field of the Invention

This invention is concerned with improvements in machines for conforming portions of shoe uppers to the shapes of their corresponding lasts.

2. Prior Art

Various proposals have been made to provide automatic or semi-automatic shoe machines for lasting side portions of shoes which require little or no attention by a machine operator apart from presentation of the shoe and removal of the shoe from the machine. It has been proposed to load and unload machines by an automatic shoe presenting and removing device. Some of the proposed machines employ helically ribbed wiping rolls for wiping marginal portions of an upper of a shoe assembly. For example, U.S. Pat. No. 3,591,878, assigned to the assignee of the present invention, discloses a shoe machine having independently mounted wiping rolls for performing a side lasting operation simultaneously along the opposite side portions of a shoe assembly. The wiping rolls are displaced widthwise of the shoe assembly in accordance with variations of outline shape of the shoe bottom, utilizing template means for controlling the widthwise displacement of the wiping rolls as they operate progressively along the shoe bottom. The U.S. Pat. No. 3,908,216, also assigned to the assignee of the present invention, discloses a shoe machine having lasting rolls which are arranged to simultaneously wipe marginal portions of opposite sides of the upper of a shoe assembly so that the upper and insole become secured together by adhesive applied therebetween. Means for effecting relative movement lengthwise between the lasting rolls and the shoe supporting means causes the rolls to operate progressively along side portions of the shoe assembly. Each of the lasting rolls has a wiping element disposed helically about a circumferential portion of the roll. The lasting rolls are supported by roll-carrying means that extend at least substantially widthwise of the shoe assembly being operated upon. The roll-carrying means are capable of arcuate movement about an axis extending generally lengthwise of the bottom of the shoe assembly. The side lasting rolls of the machine just referred to are of sufficient length to operate upon the marginal portions of the upper without widthwise displacement of the rolls. The specification of U.S. Pat. No. 3,971,089, again also assigned to the assignee of the present invention, describes a machine which is generally similar but which has means for changing the angle included between the axes of the two lasting rolls at the opposite sides of the shoe to suit it to different transverse curvatures of different portions of the shoe bottom.

Various proposals have been made to combine lasting of a shank portion of a shoe assembly with a heel seat lasting operation on the shoe assembly in a single machine which would effect a reduction of manpower as compared with a two-machine system requiring two operators. While some success has been achieved by the use of the combined machines, the machines have had certain limitations as to the extent of the side lasting operations. Some of the proposals have required a considerable amount of adjustment of the lasting arrangement by the machine operator and are not fully automatic machines.

One of the various objects of the present invention is to provide an improved shoe machine having heel seat lasting and side lasting arrangements which are capable of automatically lasting the whole of the side and seat portions of a shoe assembly heelwardly of the portion lasted by a pulling over and toe lasting machine.

SUMMARY OF THE INVENTION

The present invention provides, in accordance with one of its several features, a shoe machine for automatically lasting side and heel seat portions of a shoe assembly. The machine comprises shoe supporting means for supporting a shoe assembly including an upper and insole assembled on a last, side lasting instrumentalities provided by a pair of side lasting rolls which are supported by roll carrying means so that axes about which the rolls rotate extend at least substantially widthwise of the shoe assembly being operated upon, means for rotating the lasting rolls to wipe marginal portions of the upper so that the marginal portions of the upper and insole may become secured together by adhesive applied therebetween. The side lasting operation being caused to move in a direction extending lengthwise of the shoe assembly, between the shoe supporting means and the lasting rolls. Means are also provided for bringing about such relative movement the shoe supporting means and the lasting rolls. A heel seat lasting arrangement is included which comprises a pair of wipers. Means for effecting advancing and closing movements of the wipers permits them to wipe marginal portions of the upper around the heel seat portion of the shoe assembly. The side lasting operation and the heel seat lasting operation take place in sequence.

We have found good lasting results if the side lasting operation commences where the previous toe lasting operation ends and proceeds toward the heel end of the shoe. If the side lasting operation is performed before the seat lasting operation, the side lasting rolls, as they approach the breastline region, act to draw in the upper reinforced by the counter in the vicinity of the stiffener corners avoiding the use of breastline pincers which might otherwise be necessary to lay in these portions of the upper prior to the seat lasting operation if the seat lasting were performed before the side lasting operation.

It is convenient to present the shoe assembly heel end first to the shoe supporting means. The side lasting rolls should be located in advance of the seat lasting wipers and a shoe assembly is presented to the shoe supporting means with toe end pointing toward the operator. The machine may include shoe-length measuring means and means for automatically positioning the shoe assembly in the correct position for the commencement of the side lasting operation. During the side lasting operation, the shoe supporting means will be moved to cause the side lasting operation to progress toward the heel end of the shoe assembly. At the completion of the side lasting operation, the shoe is then moved heelwardly into position to be operated upon by the heel seat wipers. The heel seat lasting operation is similar to a conventional seat lasting operation.

We prefer to provide means for increasing the pressure of the lasting margin against the heel seat wipers after they have completed their inwiping action to provide a bedding effect. We prefer to provide a wiper head in which the heel seat wipers are mounted for their wiping movements which may be moved heightwise away from the heel seat portion of the shoe assembly prior to the opening of the wipers. It is convenient to hingely support the wiper head about a transverse axis positioned at the rear of the wiper head and to provide a toggle arrangement at a front end portion of the wiper head with means for straightening the toggle arrangement when it is desired firmly to support the wiper head in wiping position and for breaking the toggle arrangement after the completion of the inwiping movement and the bedding operation to tilt the wiper head upwardly to relieve pressure of the wipers against the inwiped marginal portions of the upper. The shoe supporting means then may move the shoe assembly into position for unloading the shoe support and reloading it for the commencement of the side lasting operation.

DESCRIPTION OF THE DRAWINGS

In order that the above and others of the various objects of the invention, and its several features, may become more clear there will now be given, with reference to a partial side elevational drawing, a description of a machine constructed according to the principles of the present invention.

DESCRIPTION OF THE PREFERRED EMBODIMENT

The illustrative machine is a shoe machine having side lasting arrangements comprising a pair of rotatable helically ribbed lasting rolls 1 for simultaneously wiping marginal portions of an upper of a shoe assembly inwardly along opposite side portions of the shoe assembly during relative movement therebetween, a heel seat lasting arrangement comprising a pair of conventional heel seat wipers mounted for advancing and closing movements in a wiper head 3, and shoe supporting means 5 for supporting the shoe assembly during the side lasting and heel seat lasting operations. The shoe supporting means is disposed upon a carriage 7 which is mounted, for movement in directions extending lengthwise of a shoe assembly supported on the shoe supporting means, upon a pair of parallel, horizontal bars 9 which are spaced apart widthwise of the machine and are supported by clamping members 11 supported upon fixed frame members 13 of the machine. Movement of the carriage 7 along the bars 9 permits movement of a shoe assembly relative to the wiping rolls 1 and also to move the shoe assembly between a loading position and positions for the commencement of side lasting and the heel seat lasting operations.

The shoe supporting means comprises a last pin 15 mounted upstanding from a block 16 which is mounted for limited sideways displacement and tilting movement in a plane extending lengthwise of the shoe assembly upon a block 17 formed at an upper end portion of a jack post 19 slidable heightwise in a bore extending through a sleeve member 21. A lower end portion of the jack post 19 protrudes beneath a lower end portion of the sleeve member as shown in the Figure. A mid portion of the jack post 19 is provided with a piston 23 slidable in a cylinder 25 formed in the sleeve member 21, a seal being formed at the lower side of the piston. Air under pressure may be admitted to a lower end portion of the cylinder 25 to raise the jack post 19 with respect to the sleeve member 21. The initial heightwise position of the jack post 19 is determined by engagement of the block 17 with a knurled head 27 of a sleeve 29 threaded into an upper end portion of the sleeve member 21. Rotation of the jack post 19 within the sleeve member 21 is restricted by means of a key 31 extending from the jack post into a slot 33 disposed lengthwise off the sleeve member 21.

A lower end portion of the sleeve member 21 is pivotally supported upon a pivot pin 35 extending widthwise betwen depending portions 37 of the carriage 7. A piston and cylinder arrangement 39 is provided for imparting swinging movements to the sleeve member 21 (and hence to the jack post 19) between a forwardly inclined position as is shown in the Figure to a position in which the jack post is generally vertical. The piston and cylinder arrangement 39 is supported by a rearward portion of the carriage 7 and has a piston rod 41 which is pivotally connected with an arm 43 fixedly secured to the sleeve member.

A heel band assembly indicated by the reference numeral 30 and a pair of side clamping assemblies 32 are supported upon a bracket 34 secured upon an upper portion of the carriage 7.

The shoe supporting means also comprises a toe pad 72 which is mounted on a piston and cylinder arrangement 74, a cylinder of which is secured to an upwardly extending arm 52 of a lever having a second (downwardly extending) arm 54. The lever 52, 54 is pivoted, at 56, between arms 58 extending forwardly from the sleeve member 21. The arm 54 is pivotally connected, at 61, with a cylinder 62 from both ends of which extends a piston rod 63. A rear end portion of the piston rod 63 is pivotally connected with a block fixed to a lower end portion of the sleeve member 21. When air under pressure is admitted to cylinder 62 behind the piston therein, the two-armed lever 52, 54 is swung clockwise to carry a plate 68 supported thereon toward the toe end portion of the shoe assembly supported upon the last pin 15 thereby to cause an actuator 69 pivoted on the plate 68 to be swung into engagement with the plate 68 actuating a switch or valve device which causes a piston and cylinder device 67 to operate a bar lock device acting on the piston rod 63 to lock it with the plate 68 holding the actuator 69 in toe engaging position. This effects a measurement of the length of the shoe assembly for a purpose hereinafter referred to and locates the tow pad 72 beneath the forepart of the shoe assembly ready to be moved into supporting engagement with the shoe assembly. Air under pressure is admitted to the cylinder 74, to raise the pad 72, whereupon a bar lock arrangement 75 prevents retraction of the toe pad but allows the air pressure to be removed from the toe pad raising cylinder.

The carriage 7 is moved lengthwise along the bars 9 by a piston and cylinder device 80 comprising a cylinder 82. The cylinder 82 is pivotally mounted upon a bracket supported between frame members of the machine, a piston rod 86 of the piston and cylinder device 80 being connected with the carriage 7.

Initially the carriage is held in a shoe loading position in which it is shown in the Figure by air under pressure being applied to the righthand end portion of the cylinder 82, as seen in the Figure, which urges the piston rod 86 to the left to an intermediate position in which it is held by the action of a hydro-check arrangement 85 connected to the cylinder 82 and to the carriage 7.

With the jack post occupying a forwardly inclined position, a shoe assembly may be placed on the jack with the last supported upon the last pin 15 and the top surface of the last engaging an upper surface of the block 16. A cycle of operations of the machine may then be initiated, as by operating a valve in a control circuit of the machine, which brings about first of all the supply of air under pressure to the cylinder of piston and cylinder device 39 and to cylinder 25 to swing the sleeve member 21 and jack post 19 therein rearwardly in the machine and at the same time to raise the jack post 19. The heel end portion of the shoe assembly is then nested within a heel band 110 of the heel band assembly 30 and the seat portion of the insole is located against a locating foot 40. The foot 40 is, at this time, arranged to be held in a lowered (operative) position by means of air under pressure supplied to an upper end portion of a cylinder 47 which is secured to a bracket 49 fastened to a portion of the machine frame, the foot 40 being mounted upon a lower end portion of a piston rod 45 extending from the cylinder 4. It will be understood that the locating foot 40 is then held at a heightwise position which serves to locate the heel seat portion of the shoe assembly at the correct height with respect to the wiping plane of the heel seat lasting wipers. The pressure of air supplied to the cylinder 47 is sufficient to resist the up thrust of the shoe assembly by the jack post 19 under the action of compressed air admitted to the cylinder 25. The jack post 19 is held in the desired position by the action of a bar lock 20, pivoted at 22 on the sleeve member 21, which is on the jack post 19, the bar lock being controlled by a piston and cylinder device 24.

The bar lock 20 is effective to prevent retraction of the jack post so that air pressure may be removed from the cylinder 25 but the shoe assembly is not lowered. The foot 40 is then raised to an out-of-the-way position by reversal of the supply of air pressure to the cylinder 47.

The heel band 110 is then caused to close about the heel end portion of the shoe assembly and side clamps of the side clamping assemblies engage opposite sides of the shoe assembly to centralize the shoe assembly whether the shoe be one for a left foot or for a right foot.

The lever 52, 54 is then swung clockwise as seen in the Figure (by action of the cylinder 62) to move the plate 68 (and actuator 69) into toe engaging position. Then air under pressure is supplied to the cylinder 74 to raise the toe pad 72 into supporting engagement with the forepart of the shoe assembly in which position it is held by action of the bar lock arrangement 75. The shoe assembly is now firmly clamped and supported on the shoe supporting means ready for the commencement of the lasting operation.

The side lasting operation is preferably preformed before the seat lasting operation because the action of the lasting rolls serves to draw the so-called corners of the counter in the heel end portion of the upper and associated portion of the upper closely into relationship with the last before the heel seat lasting operation commences. If the heel seat lasting operation is performed before the side lasting operation it may be necessary to provide the machine with breast line pincers to pull these portions of the upper end counter inwardly until they are held closely adjacent the corresponding portions of the last prior to the heel seat lasting operation. Otherwise the subsequent action of the side lasting rolls may, by exerting a further inwiping action on the upper marginal portions in the region of the heel breastline, cause an undesired crease to be formed in the upper.

Before the side lasting operation commences, the carriage 7 must be moved lengthwise of the shoe assembly to correctly position the shoe assembly with respect to the side lasting rolls 1 and nozzle members 2. The nozzle members 2 then apply adhesive to marginal portions of the insole prior to action of the lasting rolls.

The shoe length is measured by the arrangement of levers 52, 54 and toe engaging plate 68 to bring about a corresponding positioning of a stop rod 90, which serves the function of the stop rod of the machine disclosed in said specification of U.S. Pat. No. 3,849,817, assigned to the assignee of the present invention. The stop rod 90 is slidably mounted (for movements parallel to the bars 9) in a housing 92 carried by a side portion 94 of the carriage 7, and is set in the desired lengthwise position by engagement of a first end portion of the stop rod 90 by a set screw 96 carried by the arm 52. The stop rod 90 (which may be a two-part rod interconnected with a rack and pinion gearing) is held in adjusted position by action of a bar lock arrangement (not shown). After removal of the locating foot 40 from engagement with the shoe bottom, the carriage 7 is moved to the right as viewed in the Figure under the action of the piston and cylinder arrangement 80 to a position determined by operation of the hydro-check arrangement 85 under action of a trigger switch (or valve) operated by the stop rod 90 on movement of the carriage. Rearward movement of the carriage is terminated with the shoe assembly located in the desired position for the commencement of the side lasting operation at a location adjacent the heelward termination of the previously lasted toe portion of the upper.

The nozzle members 2 form part of adhesive applying means with which the illustrative machine is provided for applying adhesive along the marginal portions of the insole at opposite sides of the shoe assembly as the lasting operation progresses. The nozzle members 2 of the adhesive applying means are supported by nozzle carriers 22 (one at one side of the machine and one at the other) mounted for swinging movements (about axes generally parallel to the lengthwise direction of the bottom of the shoe assembly being operated upon) relatively to supporting arms 26 (one for each nozzle carrier). The arms 26 are pivoted about a cross shaft 28 and are rotatable in bearings carried by supports 83 mounted upon an upper portion of the machine frame. Rising and falling movements of the nozzle members 2 are controlled by piston and cylinder arrangements 84. The piston and cylinder arrangements 84 correspond to a similar piston and cylinder arrangement of the machine disclosed in the specification of our U.S. Pat No. 3,915,115. The adhesive applying means comprises means for controlling the widthwise displacement of the nozzle members during the adhesive applying operation to cause the nozzle members to follow paths in the vicinity of the insole margin.

Each side lasting roll 1 has a shaft 106 driven by a belt 10 and pulley 12 from an electric motor so that the rolls 1 may rotate continuously during operation of the machine, the rolls being provided with helically disposed wiping elements.

Each shaft 106 is mounted in a bearing block fixedly secured to a roll carrier 114 in the form of an arm pivoted about a common pivot pin 116. The axis of the pin 116 extends generally lengthwise of the shoe assembly being operated upon at a level just above the shoe bottom and centrally disposed with respect to inner end portions of the rolls 1. The pin 116 is carried by a support member 120 which is fixedly secured to front end portions of a pair of arms 122, rearward end portions of which are pivotally supported upon the cross shaft 28 permitting rising and falling movements of the rolls 1. The rolls 1 are urged toward the shoe bottom during the lasting operation by means of a piston and cylinder arrangement 256 acting on the arms 122 through a second arm 124. The rolls 1 are driven, through cogged belts and pulleys, from the cross shaft 28 which itself is driven by a similar belt and pulley drive, from an electric motor 150.

Extending upwardly and crosswise from each roll carrier 114 is a pair of arms 126 and a pair of similar arms 128 (not shown) for the right hand carrier 114. The arms 126, 128 cross over and upper end portions of the arms are connected to a piston rod 130 and cylinder 132 of a piston and cylinder arrangement 134. The piston and cylinder arrangement 134 provides means for adjustably determining the angular disposition of one of said carriers 114 with respect to the other about the lengthwise extending axis provided by the pin 116, while permitting the two carriers together to partake of arcuate movement about the axis. The piston and cylinder arrangement 134 is arranged to move the arms 126, 128 between positions determined by adjustable stop means (not shown) which is generally similar to that of the machine described in the aforementioned U.S. Pat. No. 3,915,115.

The piston and cylinder arrangement 134 is connected in a control circuit arrangement (not shown) of the machine which includes valve means (not shown) for controlling the supply of fluid (e.g. air) under pressure to the cylinder 132 so that, in one position of the valve means, the piston rod 130 is extended from the cylinder 132 to swing the arms 124, 128 outwardly (to a limit set by the stop means just above referred to) to decrease the angle between the axes of the lasting rolls to an amount suitable for the rolls to operate in a relatively flat region of the shoe bottom. In the other position of the valve means the piston rod 130 is drawn inwardly with respect to the cylinder 132 to swing the arms 126, 128 inwardly (to another limit set by the last mentioned stop means) to increase the angle between the axes of the lasting rolls to an amount suitable for the rolls to operate in a more transversely curved region of the shoe bottom.

Since there may well exist a difference in transverse curvature of the shoe bottom, as between the forepart region and the seat region for example, the valve means referred to in the previous paragraph may conveniently be operated by a trigger device (or devices) actuated as a consequence of movement of the carriage 7 as it traverses a shoe assembly beneath the lasting rolls during the lasting operation. The trigger device (or devices) may be approximately positioned on the machine frame in a direction extending lengthwise of the shoe assembly. It will be appreciated that during the lasting operation the lasting roll assembly may tilt as a whole about the axis of the pin 116 to equalize the roll pressure at opposite sides of the shoe bottom despite any "twist" that may occur in the general plane of the shoe bottom (considered about an axis extending generally lengthwise of the shoe assembly) as is the case of the machine disclosed in the last mentioned specification. It will furthermore be understood that the pressure of air supplied to the piston and cylinder arrangement 134 will be sufficient to avoid individual displacement of the roll axes about the pivot pin 116 under the action of downward pressure of the rolls upon the shoe bottom brought about by action of the piston and cylinder 256. With the arrangement above described it is therefore possible positively to "program" the relative disposition of the roll axes (by control of angle included between the roll axes as above referred to) during a side lasting operation to suit changes in transverse curvature of portions of the shoe bottom successively engaged by the rolls, e.g., in a relatively flat forepart, the more curved shank region and the generally flatter portion in the vicinity of the breastline region.

After the carriage 7 has been moved lengthwise of the shoe assembly to cause the rolls 1 to effect the side lasting operation, terminating at about the heel breastline, the adhesive applying nozzles 2 and wiping rolls 1 are raised to their inoperative positions and the carriage 7 is then moved rearwardly in the machine to locate the heel seat portion of the shoe assembly in position to be operated upon by the heel seat wipers in the wiper head 3. It will be appreciated that, in presenting a shoe assembly to the heel seat lasting arrangement, it is convenient to present the shoe assembly heel end first (i.e., toe end toward an operator standing in front of the machine) as is conventional practice in the operation of heel seat lasting machines. The illustrative machine is therefore so organized that the side lasting rolls 1 are located in advance of the seat lasting wipers in the wiper housing 3. The shoe assembly is presented to the shoe supporting means (while the latter is in a so-called loading position) with toe end pointing toward the operator (as shown in the drawing). An adhesive applying member is moved into position adjacent to the heel seat portion of the insole on arrival of the shoe assembly in the seat lasting position, and is caused to extrude adhesive on to marginal portions of the insole and/or upper material in the heel seat region. Upon removal of the adhesive applying member and inwiping of the marginal portions of the upper in well known manner by the heel seat wipers, marginal portions of the upper and insole may become secured together in lasted relationship. The heel seat lasting operation performed by the illustrative machine is like a conventional cement seat lasting operation and need not be described herein. After the inwiping operation of the wipers, while they remain in their advanced and closed condition, upward pressure is applied to the jack post 19 to bed the overlasted marginal portions of the upper against the insole by pressure applied against the wipers. For this purpose there is provided a diaphragm type air motor 169 which is supported between frame members 152 of the machine. The motor 169 has a ram 154 which, when the shoe carriage 7 is in its rearmost position for the heel seat lasting operation, is located directly beneath the jack post 19. Upward displacement of the ram 154 acts on the jack post 19 to press the shoe assembly supported thereon firmly against the heel seat wipers for the bedding operation. At the conclusion of the seat lasting operation, pressure applied by the motor 169 is removed, the bar lock 20 is released and the jack post is lowered as the clamping effect of the heel band and side clamps is relieved, thus allowing the shoe assembly to be moved back to loading position and the wipers to be opened.

If for any reason it is desired to perform the heel seat lasting operation prior to the side lasting operation, it is undesirable to allow the heightwise position of the shoe assembly to be disturbed by lowering the jack post as just above described to permit retraction of the heel seat wipers at the conclusion of the bedding operation, since that would involve a resetting of the heightwise position of the shoe assembly prior to the commencement of the side lasting operation. In the illustrative machine, therefore, the wiper head (in which the heel seat wipers are mounted for their wiping movements) is so mounted that it may be moved heightwise away from the heel seat portion of the shoe assembly prior to the opening of the wipers. For this purpose the wiper head 3 is hingedly mounted about a transverse axis positioned at the rear of the wiper head. A toggle arrangement is provided at a front end portion of the wiper head with means for straightening the toggle arrangement when it is desired to firmly support the wiper head in wiping position and to break the toggle arrangement after the completion of the inwiping movement of the wipers and the bedding operation to tilt the wiper head upwardly to relieve pressure of the wipers against the inwiped marginal portions of the upper. Thereupon the shoe supporting means may move the shoe assembly into position for the commencement of the side lasting operation. The rearward end portion of the wiper head is therefore mounted upon a cross shaft 160 extending transversely of the machine between frame members thereof. The toggle arrangement just above referred to comprises, at each side of the machine, a lower toggle link 162 and an upper toggle link 164 having a rearwardly extending portion 165. The upper link 164 of each toggle is pivotally connected to the lower link (to provide the knee of the toggle) by a pin 166 while the lower links of the two toggles are pivotally connected to the wiper head by pins 170. Upper end portions of the links 164 are pivotally connected to a cross shaft 168 which is firmly supported by upstanding portions 172 of the frame. The frame portions 172 are rigidly connected with the side frame members 152 supporting the diaphragm motor 169. The portions 165 of the toggle links 164 are connected with a head portion of a piston rod 174 extending forwardly from a piston (not shown) slidable in a cylinder 176. Air pressure applied to a rear portion of the cylinder 176 straightens the toggle arrangement 162, 164 firmly to hold the wiper head in a (horizontal) operative position for the inwiping and bedding operation. Reversal of compressed air supply connections to the cylinder 176 withdraws the piston rod 174, breaking the toggle arrangement, and raising the front end portion of the wiper head 3, tilting it upward about the cross shaft 160. This relieves the pressure of the closed wipers upon the overwiped upper before the wipers are opened and permits the heel seat lasted shoe assembly to be moved to a predetermined position for the commencement of the side lasting operation without any need for lowering the jack post 19.

If the heel seat lasting operation is to be effected prior to the side lasting operation it will be appreciated that, after a shoe assembly has been loaded on to the jack post 19 and the latter has been swung rearwardly and raised to operative position to locate the heel seat portion of the insole against the locating foot 40 as hereinbefore described, the shoe assembly will be clamped in position, the locating foot raised as hereinbefore described and the carriage 7 will then be moved fully rearward to position the shoe assembly in position to be operated upon by the heel seat lasting arrangement. After the seat lasting operation, and release of the wiping pressure by upward swinging movement of the wiper head 3 as just described, the carriage 7 is moved to a position in accordance with the setting of the stop rod 90 for the commencement of the side lasting operation, during which the carriage 7 is against moved forwardly to cause the action of the rolls 1 to proceed along the side portions of the shoe assembly to about the heel breast line. The rolls 1 are then raised and the carriage 7 is moved to loading position, the clamping arrangements release the shoe assembly and the jack post 19 is swung forward and lowered to its initial position.

Having thus described my invention what I claim as new and desire to be secured by Letters Patent of the United States is:

1. A shoe machine for automatically lasting side and heel portions of a shoe assembly, and machine comprising:

shoe assembly supporting means for supporting a shoe assembly, said shoe assembly comprising an upper and an insole assembled on a last;

a side lasting arrangement comprising a pair of side lasting rolls, each of said lasting rolls having a wiping element disposed helically about a circumferential portion of lasting roll;

said lasting rolls being supported by roll carrying means so that the axes about which said lasting rolls rotate extend at least substantially widthwise of any shoe assembly being operated upon;

means for rotating said lasting rolls in such directions that they operate to wipe marginal portions of said upper at opposite sides of a shoe assembly inwardly with respect to said insole of said shoe assembly so that the marginal portions of said upper and said insole may become secured together after an application of adhesive has been applied therebetween, the side lasting operation caused to progress along the opposite sides of said shoe assembly during relative movement in a direction extending lengthwise of said shoe assembly between said shoe supporting means and said lasting rolls;

means for providing relative movement between said shoe supporting means and said lasting rolls;

a heel seat lasting arrangement comprising a pair of wipers including means for effecting advancing and closing movements of said wipers to cause them to wipe marginal portions of said upper around said heel seat portion of said shoe assembly;

a shoe length measuring arrangement which permits positioning of said shoe assembly support means prior to the side lasting operation;

said shoe assembly supporting means being comprised of a slidably mounted carriage which permits movement in a direction extending lengthwise of said shoe assembly; and said supporting means also comprising a pneumatically operated cylinder disposed to raise and lower said shoe assembly therewith, including a pivotal base on said support, and a pneumatically operated cylinder attached to impart motion thereto.

2. A shoe machine as recited in claim 1, wherein said heel seat lasting arrangement includes:

a pressurizable movable ram which displaces said shoe support in the generally vertical direction against said heel wipers to provide a bedding pressure thereagainst, said ram being depressurizable upon completion of the seat lasting operation, permitting said shoe assembly to be arcuately returned to its shoe loading-unloading position, said heel wiping following the side lasting portion of said shoe lasting operation.

3. A shoe machine as recited in claim 1 wherein said heel seat wiper arrangement is hinged at a rear portion thereof to permit said wiper arrangement to be pivoted away from the heel seat portion of said shoe assembly.

4. A shoe machine as recited in claim 3 wherein a toggle arrangement is provided at a front portion of said heel seat wiper arrangement, said toggle arrangement having means for straightening thereof to provide firm support for said heel seat wiper when it is in its wiping position.

* * * * *

UNITED STATES PATENT OFFICE

CERTIFICATE OF CORRECTION

Patent No. 4,006,504 Dated Feb. 8, 1977

Inventor(s) Ronald O.C. Gadd

It is certified that error appears in the above-identified patent and that said Letters Patent are hereby corrected as shown below:

Column 10, Cl. 1, Line 15 delete the word "and" insert --said--

Column 10, Cl. 1, Line 23, after the word"of" insert --said--

Signed and Sealed this

Twelfth Day of April 1977

[SEAL]

*Attest:*

RUTH C. MASON
*Attesting Officer*

C. MARSHALL DANN
*Commissioner of Patents and Trademarks*